US007007684B2

(12) United States Patent
Itakura et al.

(10) Patent No.: US 7,007,684 B2
(45) Date of Patent: Mar. 7, 2006

(54) CONTROLLER FOR INTERNAL COMBUSTION ENGINE

(75) Inventors: Hideaki Itakura, Nagoya (JP); Takanobu Kawano, Oobu (JP); Naoya Kato, Aichi-ken (JP); Kenji Kasashima, Aichi-ken (JP); Rihito Kaneko, Aichi-ken (JP)

(73) Assignees: Nippon Soken, Inc., Nishio (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/146,145

(22) Filed: Jun. 7, 2005

(65) Prior Publication Data

US 2005/0274368 A1 Dec. 15, 2005

(30) Foreign Application Priority Data

Jun. 11, 2004 (JP) ..... 2004-174533

(51) Int. Cl.
*F02M 33/02* (2006.01)
*F02D 41/30* (2006.01)

(52) U.S. Cl. ..... 123/698; 123/520; 701/103

(58) Field of Classification Search ..... 123/698, 123/519–521, 480, 486, 492–494; 701/103–105
See application file for complete search history.

(56) References Cited

U.S. PATENT DOCUMENTS

| | | | | |
|---|---|---|---|---|
| 5,862,795 | A * | 1/1999 | Osanai | 123/520 |
| 5,884,609 | A * | 3/1999 | Kawamoto et al. | 123/520 |
| 6,095,121 | A * | 8/2000 | Osanai | 123/520 |
| 6,102,003 | A * | 8/2000 | Hyodo et al. | 123/436 |
| 6,227,177 | B1 * | 5/2001 | Yamafuji et al. | 123/520 |
| 6,438,945 | B1 * | 8/2002 | Takagi et al. | 60/283 |
| 6,666,198 | B1 * | 12/2003 | Mitsutani | 123/674 |
| 6,675,788 | B1 * | 1/2004 | Inoue et al. | 123/698 |
| 6,708,682 | B1 * | 3/2004 | Osanai | 123/698 |
| 6,729,319 | B1 * | 5/2004 | Mitsutani | 123/687 |

FOREIGN PATENT DOCUMENTS

| | | |
|---|---|---|
| JP | 06-101517 | 4/1994 |
| JP | 11-062729 | 3/1999 |
| JP | 2000-274294 | 10/2000 |
| JP | 2003-138991 | 5/2003 |
| JP | 2003-184663 | 7/2003 |

* cited by examiner

*Primary Examiner*—Hai Huynh
(74) *Attorney, Agent, or Firm*—Kenyon & Kenyon

(57) ABSTRACT

A controller for an engine including a fuel vapor processing mechanism. The controller determines the amount of fuel vapor drawn into an intake passage based on the concentration of fuel vapor purged into the purge passage. The controller corrects the fuel injection amount of a fuel injection valve in accordance with the determined amount of fuel vapor. The controller starts correcting the fuel injection amount from the cylinder that is undergoing an intake stroke when the crankshaft is rotated to a certain crank angle.

21 Claims, 7 Drawing Sheets

CONTROLLER FOR INTERNAL COMBUSTION ENGINE

CROSS-REFERENCE TO RELATED APPLICATIONS

This application is based upon and claims the benefit of priority from prior Japanese Patent Application No. 2004-174533, filed on Jun. 11, 2004, the entire contents of which are incorporated herein by reference.

BACKGROUND OF THE INVENTION

The present invention relates to a controller for an internal combustion engine.

Recent internal combustion engines for vehicles include fuel vapor processing mechanisms. A fuel vapor processing mechanism collects fuel vapor, which is generated in a fuel tank, with a canister, and prevents the fuel vapor from being released into the atmosphere. To maintain the amount of fuel vapor collected in the canister below an upper limit, the fuel vapor processing mechanism desorbs fuel vapor from the canister and draws the desorbed fuel vapor into an intake passage via a purge passage when the engine is running. The fuel vapor is then burned in combustion chambers. This processing is referred to as "purging of fuel vapor". The purging of fuel vapor restores the fuel vapor collection capability of the canister.

When purging is being performed, fuel injected from a fuel injection valve is drawn into the corresponding combustion chamber of the engine together with the fuel vapor desorbed from the canister. The fuel injection control executed during purging estimates the amount of fuel added by the purging and corrects the fuel injection amount of the fuel injection valve. This prevents the air-fuel ratio from being affected by purging.

A certain length of time is required from when the purging is started until when the purged fuel vapor reaches the combustion chambers defined in cylinders. The correction of the fuel injection amount must take into consideration such delay time of the fuel vapor. Japanese Laid-Open Patent Publication No. 11-62729 describes a controller that calculates a value compensating for the transfer delay based on the engine speed. The controller then uses the compensation value to calculate a fuel amount corresponding to the purged amount of fuel vapor, or the fuel amount required due to purging, and corrects the fuel injection amount.

Regulations regarding the amount of fuel vapor released into the atmosphere have become stricter. This has resulted in demands for canisters with higher fuel vapor collecting capabilities. To satisfy such demands, the amount of purged fuel vapor may be increased so that the canister promptly recovers its fuel vapor collecting capability.

When a larger amount of fuel vapor is purged, the purged amount of fuel vapor tends to differ from the corresponding fuel injection correction amount. This difference lowers the correction accuracy of the fuel injection amount and must thus be eliminated.

The controller of Japanese Laid-Open Patent Publication No. 11-62729 fails to consider the timing for correcting the fuel injection amount in accordance with the purged fuel vapor amount. Thus, the controller may fail to perform fuel injection correction in accordance with changes in the concentration of fuel vapor. For example, the controller may excessively decrease the fuel injection amount even though the concentration of fuel vapor in the intake passage is not that high. Also, the controller may excessively increase the fuel injection amount even though the concentration of fuel vapor in the intake passage is not that low.

SUMMARY OF THE INVENTION

It is an object of the present invention to provide a controller for an internal combustion engine that performs fuel injection correction in accordance with changes in the concentration of fuel vapor.

One aspect of the present invention is a controller for an internal combustion engine connected to a fuel tank. The engine includes a crankshaft, at least one cylinder, at least one fuel injection valve associated with the at least one cylinder, and a fuel vapor processing mechanism. The fuel vapor processing mechanism includes a canister for collecting fuel vapor generated in the fuel tank, a purge passage connecting the canister and an intake passage of the internal combustion engine for purging fuel vapor desorbed from the canister into the intake passage, and a purge valve arranged in the purge passage for adjusting fuel vapor amount in the purge passage. The controller includes a memory for storing a first crank angle, which is an angle of the crankshaft at the timing of opening of the purge valve. The controller determines the amount of fuel vapor drawn into the intake passage based on concentration of the fuel vapor that is purged into the purge passage. The controller corrects a fuel injection amount for the at least one fuel injection valve in accordance with the determined amount of fuel vapor. A processor determines a first crank rotation angle by which the crankshaft is rotated during a delay time required for the fuel vapor to move from the purge valve to a position closer to the fuel injection valve, based on intake air pressure in the intake passage, and adds the first crank rotation angle to the first crank angle to determine a second crank angle. The controller starts decreasing the fuel injection amount from the cylinder that is undergoing an intake stroke when the crankshaft is rotated to the second crank angle.

Another aspect of the present invention is a controller for an internal combustion engine connected to a fuel tank. The engine includes a crankshaft, at least one cylinder, at least one fuel injection valve associated with the at least one cylinder, and a fuel vapor processing mechanism. The fuel vapor processing mechanism includes a canister for collecting fuel vapor generated in the fuel tank, a purge passage, connecting the canister and an intake passage of the internal combustion engine, for purging fuel vapor desorbed from the canister into the intake passage, and a purge valve arranged in the purge passage for adjusting fuel vapor amount in the purge passage. A memory stores a first crank angle, which is an angle of the crankshaft at the timing of closing of the purge valve. The controller determines fuel vapor amount drawn into the intake passage based on concentration of the fuel vapor that is purged into the purge passage, and the controller corrects a fuel injection amount of the at least one fuel injection valve in accordance with the determined amount of fuel vapor. A processor determines a first crank rotation angle, by which the crankshaft is rotated during a delay time required for the fuel vapor to move from the purge valve to a position close to the fuel injection valve, based on intake air pressure in the intake passage, and adds the first crank rotation angle to the first crank angle to determine a second crank angle. The controller starts increasing the fuel injection amount from the cylinder that is undergoing an intake stroke when the crankshaft is rotated to the second crank angle.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A controller for an internal combustion engine according to a preferred embodiment of the present invention will now be described with reference to FIGS. 1 to 11.

Figure 1:
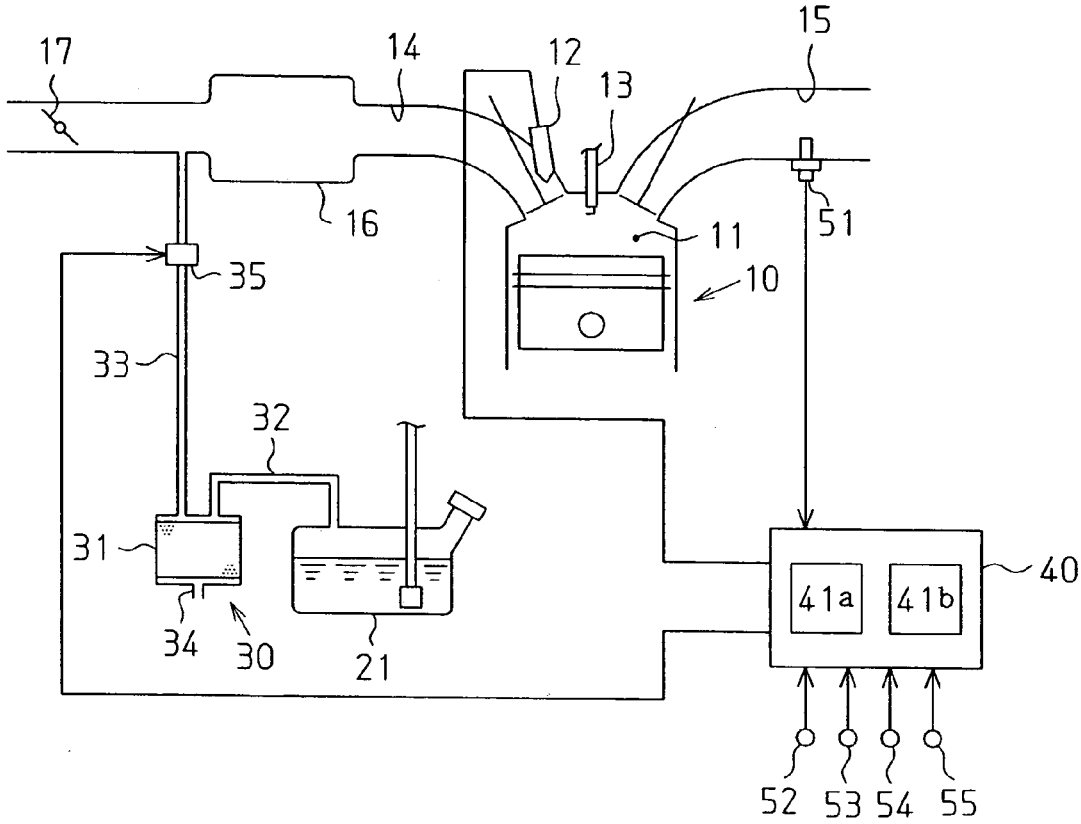
FIG. 1 is a schematic diagram of an internal combustion engine including a controller for an internal combustion engine according to a preferred embodiment of the present invention.

FIG. 1 shows an internal combustion engine 10 to which the controller of the preferred embodiment is applied. The internal combustion engine 10 includes a fuel tank 21, a fuel injection valve 12, and ignition plugs 13. The fuel injection valve 12 injects and supplies fuel to a combustion chamber 11. Each ignition plug 13 ignites a mixture of fuel and intake air. Fuel is supplied from the fuel tank 21 to the fuel injection valve 12 via a fuel supply passage.

An intake passage 14 and an exhaust passage 15 are connected to the combustion chamber 11. A surge tank 16 is arranged in the intake passage 14. In the intake passage 14, a throttle valve 17, which adjusts the amount of intake air, is arranged upstream from the surge tank 16.

The internal combustion engine 10 includes a fuel vapor processing mechanism 30. The fuel vapor processing mechanism 30 includes a canister 31, a purge passage 33, an air introduction passage 34, and a purge valve 35. The canister 31 is connected to the fuel tank 21 via a fuel vapor passage 32. The purge passage 33 connects the canister 31 to the intake passage 14 at a position downstream from the throttle valve 17. The air introduction passage 34 draws air (fresh air) into the canister 31. The purge valve 35 opens and closes the purge passage 33. The canister 31 accommodates an absorbent.

Fuel vapor generated in the fuel tank 21 is drawn into the canister 31 via the fuel vapor passage 32 and then absorbed by the absorbent in the canister 31. When the purge valve 35 opens, air enters the canister 31 through the air introduction passage 34. This sends the fuel vapor absorbed by the absorbent into the intake passage 14 via the purge passage 33. In the preferred embodiment, the fuel vapor is sent (purged) into the surge tank 16. The fuel contained in the fuel vapor is burned in each combustion chamber 11 together with the fuel injected from the fuel injection valve 12.

The purge valve 35 adjusts the amount of fuel vapor purged into the intake passage 14. In the preferred embodiment, the purge valve 35 is an electromagnetic valve. The opening degree of the purge valve 35 is changed in accordance with the duty ratio of a drive signal.

An electronic control unit (ECU) 40 executes various controls for the internal combustion engine 10. The controls executed by the ECU 40 include purge control and air-fuel ratio control for correcting the fuel injection amount of the fuel injection valve 12. The ECU 40 includes a central processing unit (CPU) 41*a*, a read only memory (ROM), a random access memory (RAM) 41*b*, a backup RAM, an external input circuit, and an external output circuit. The external input circuit of the ECU 40 is connected to various sensors for detecting the driving state of the internal combustion engine 10. The ECU 40 executes various controls in accordance with the detection signals provided from these sensors.

An air-fuel ratio sensor 51, which is arranged in the exhaust passage 15, detects the concentration of oxygen in the exhaust (the air-fuel ratio of the mixture). An intake air pressure sensor 52 detects the pressure in the intake passage 14, that is, the intake air pressure PM. The ECU 40 calculates the intake air amount Qa of the internal combustion engine 10 based on the intake air pressure PM. The intake air amount Qa may be directly detected using an airflow meter. A crank angle sensor 53 detects the rotation angle of the crankshaft (the rotation amount of the crankshaft). The ECU 40 calculates the engine speed NE and the position (the crank angle) of the crankshaft based on the detection signal of the crank angle sensor 53. A throttle sensor 54 detects the opening degree of the throttle valve 17. A coolant temperature sensor 55 detects the coolant temperature THW of the internal combustion engine 10.

The ECU 40 executes various controls in accordance with the driving state of the internal combustion engine 10 and the operating state of the vehicle, which are detected by the sensors 51 to 55. Fuel vapor purged into the intake passage 14 changes the air-fuel ratio of the mixture. For example, when fuel vapor enters the intake passage 14, the air-fuel mixture becomes rich and changes the air-fuel ratio. The ECU 40 calculates the amount of fuel vapor that is introduced into the intake passage 14 based on the concentration of the purged fuel vapor and corrects the fuel injection amount of the fuel injection valve 12 based on the calculated fuel vapor amount. This correction maintains the air-fuel ratio at a desired value.

The ECU 40 estimates the concentration of fuel vapor based on the degree of change in the air-fuel ratio that occurs when the purge valve 35 opens. The concentration of fuel vapor may be directly detected by a concentration sensor, which is arranged in the purge passage 33.

Regulations regarding the amount of fuel vapor released into the atmosphere have become stricter. Thus, the canister 31 must have a higher fuel vapor collecting capability. To satisfy such demands, the amount of purged fuel vapor may be increased so that the canister 31 promptly recovers its fuel vapor collecting capability. When a larger amount of fuel vapor is purged, the purged amount of fuel vapor tends to differ from the corresponding fuel injection correction amount. This difference lowers the correction accuracy of the fuel injection amount and must thus be eliminated.

To eliminate such a difference, the change in the concentration of fuel vapor in the intake passage 14 is accurately detected, and the fuel injection amount is corrected in accordance with the change in the fuel vapor concentration. This eliminates the difference between the purged amount of fuel vapor and the fuel injection correction amount and prevents the correction accuracy of the fuel injection amount from decreasing. Further, this enables the purging of a larger amount of fuel vapor.

The fuel injection control executed during purging will now be described with reference to FIGS. 2 to 11.

First, the detection of changes in the concentration of fuel vapor in the intake passage will be described with reference to FIGS. 2 to 7.

Figure 2:
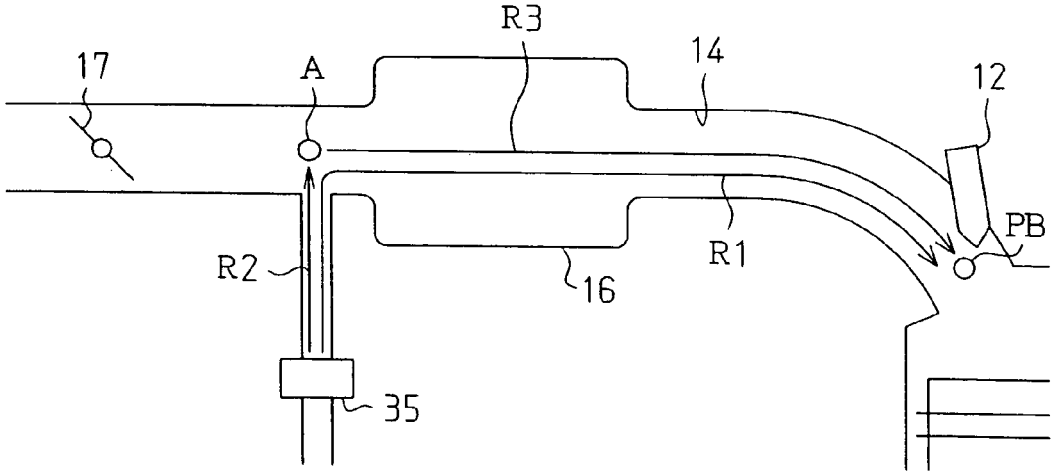
FIG. 2 shows the flow of fuel vapor that is being purged.

FIG. 2 schematically shows the flow of purged fuel vapor. The fuel vapor reaches a position close to the fuel injection valve 12 (position PB) when a transfer delay time R1 elapses after the fuel vapor passes through the purge valve 35. The fuel vapor reaches an outlet of the purge passage 33 (position PA) when a transfer delay time R2 elapses after the fuel vapor passes through the purge valve 35. The fuel vapor reaches position PB when a transfer delay time R3 elapses after the fuel vapor passes the outlet of the purge passage 33 (position PA). Accordingly, the total of the delay times R2 and R3 is equal to the delay time R1.

Figure 3:
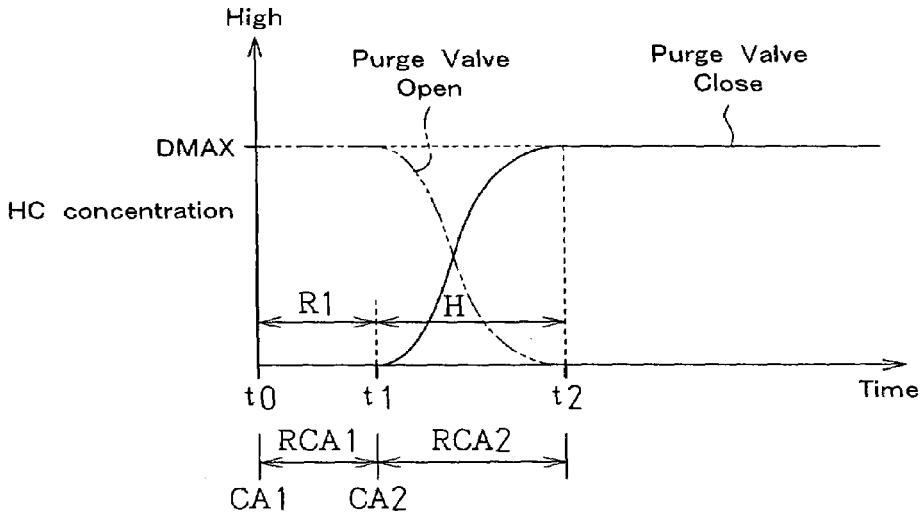
FIG. 3 is a timing chart showing changes in the concentration of fuel vapor at a position close to a fuel injection valve when a purge valve is operated in a state in which the engine is being driven and the intake air pressure is stable.

The concentration of fuel vapor, or hydrocarbon (HC) concentration, at the position close to the fuel injection valve 12 (at position PB) changes in a manner as shown in FIG. 3 when the purge valve 35 is operated while the engine is being driven under a stable intake air pressure PM (normal state). The curve drawn with a solid line indicates changes in the HC concentration at position PB when the purge valve 35 opens at timing t0. The curve drawn with a broken line indicates changes in the HC concentration at position PB when the purge valve 35 closes at timing t0.

Referring to the solid line in FIG. 3, the purge valve 35 opens at timing t0. The fuel vapor reaches the position close to the fuel injection valve 12 after the delay time R1 elapses, that is, at timing t1. At timing t1, the HC concentration at the position close to the fuel injection valve 12 starts increasing. The inventors of the present application have confirmed that the time (delay time R1) from when the purge valve 35 opens to when an increase in the concentration of fuel vapor at the position close to the purge valve 35 is detected is calculated with a relational expression that uses the intake air pressure PM as a variable, which does not depend on the engine speed NE (refer to FIG. 4).

Referring to the broken line in FIG. 3, the purge valve 35 closes at timing t0. The fuel vapor, which passes through the purge valve 35 immediately before the purge valve 35 closes, passes through the position close to the fuel injection valve 12 after the delay time R1 elapses, that is, at timing t1. At timing t1, the HC concentration at the position close to the fuel injection valve 12 starts decreasing. The inventors of the present application have confirmed that the time (delay time R1) from when the purge valve 35 is closed to when a decrease in the concentration of fuel vapor at the position close to the purge valve 35 is detected is calculated with the relational expression that uses the intake air pressure PM as a variable, which does not depend on the engine speed NE (refer to FIG. 4).

Figure 4:
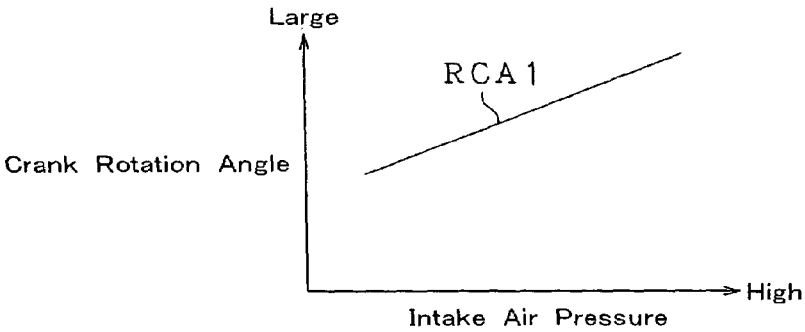
FIG. 4 is a graph showing the relationship between a first crank rotation angle and the intake air pressure.

FIG. 4 is a graph of the relational expression showing the relationship between the intake air pressure PM and the rotation angle of the crankshaft as rotated during the transfer delay time R1 (first crank rotation angle RCA1). The delay time R1 is longer and the first crank rotation angle RCA1 is greater as the intake air pressure PM increases (as the pressure in the intake passage 14 approaches atmospheric pressure). For the internal combustion engine used in the experiment, the first crank rotation angle RCA1 is expressed with a linear model expression using the intake air pressure PM as a variable.

The first crank rotation angle RCA1 corresponding to the delay time R1 is calculated based on the intake air pressure PM. The first crank rotation angle RCA1 is added to a first crank angle CA1, which is the crank angle when the purge valve 35 opens, to calculate a second crank angle CA2. The second crank angle CA2 is the crank angle when the fuel vapor that has passed through the purge valve 35 reaches the position close to the fuel injection valve 12 (timing t1). Thus, the timing when the HC concentration at the position close to the fuel injection valve 12 starts increasing (timing t1) is properly determined. The correction (decrease) of the fuel injection amount is started from the cylinder undergoing the intake stroke when the crankshaft is rotated to the second crank angle CA2. The timing in which the purged fuel amount (fuel vapor amount) is reflected in the fuel injection amount is adjusted in this manner to start the correction of the fuel injection amount at the proper timing (timing t1).

Referring to the broken line in FIG. 3, the first crank rotation angle RCA1 corresponding to the delay time R1 is also calculated based on the intake air pressure PM when the purge valve 35 closes in the same manner as described above. The first crank rotation angle RCA1 is added to the first crank angle CA1, which is the crank angle when the purge valve 35 closes, to calculate the second crank angle CA2. The second crank angle CA2 is the crank angle when the fuel vapor that has passed through the purge valve 35, immediately before the purge valve 35 closes, reaches the position close to the fuel injection valve 12 (timing t1). Thus, the timing when the HC concentration at the position close to the fuel injection valve 12 (timing t1) starts decreasing is properly determined. The correction (increase) of the fuel injection amount is started from the cylinder undergoing the intake stroke when the crankshaft is rotated to the second crank angle CA2. The timing in which the purged fuel vapor amount (fuel vapor amount) is reflected in the fuel injection amount is adjusted in this manner to start the correction of the fuel injection amount at the proper timing (timing t1).

Referring to the solid line in FIG. 3, the fuel vapor reaches the position close to the fuel injection valve 12 at timing t1. After that, the HC concentration at the position close to the fuel injection valve 12 increases gradually. The HC concentration at the position close to the fuel injection valve 12 reaches its maximum HC concentration DMAX at timing t2 and is then stabilized. In this way, the HC concentration does not become maximal in synchronization with the operation of the purge valve 35. In other words, the HC concentration does not become maximal immediately after the purge valve 35 is operated. The HC concentration becomes maximal when the concentration change time H elapses after the operation of the purge valve 35.

Referring to the broken line in FIG. 3, the purge valve 35 is closed at timing t1. After the delay time R1 elapses (timing t1), the HC concentration at the position close to the fuel injection valve 12 decreases gradually. The HC concentration becomes substantially zero at timing t2. In this way, the HC concentration does not become minimal in synchronization with the operation of the purge valve 35. In other words, the HC concentration does not become minimal immediately after the purge valve 35 is operated. The HC concentration becomes minimal when the concentration change time H elapses after the operation of the purge valve 35.

Figure 5:
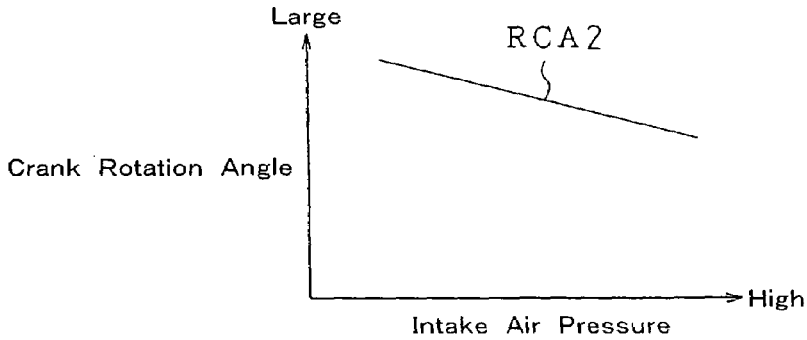
FIG. 5 is a graph showing the relationship between a second crank rotation angle and the intake air pressure.

The inventors of the present application have confirmed that the concentration change time H of the fuel vapor when the purge valve is opened or closed is calculated with a relational expression using the intake air pressure as a variable, which does not depend on the engine speed NE, in a state in which the engine is running normally and the intake air pressure is stable (refer to FIG. 5).

FIG. 5 is a graph of the above relational expression showing the relationship between the intake air pressure PM and the rotation angle of the crankshaft as rotated during the concentration change time H (second crank rotation angle RCA2). The concentration change time H is shorter and the second crank rotation angle RCA2 is smaller as the intake air pressure PM increases (as the pressure in the intake passage 14 approaches the atmospheric pressure). For the internal combustion engine used in the experiment, the second crank rotation angle RCA2 is expressed with a linear model expression using the intake air pressure PM as a variable.

The maximum change of the fuel vapor concentration in the intake passage 14 at a position close to the fuel injection valve 12 is calculated. The maximum change (difference between zero and the maximum HC concentration DMAX in FIG. 3) is calculated based on the concentration of fuel vapor in the purge passage 33, the flow amount of fuel vapor in the purge passage 33, and the intake air amount. The second crank rotation angle RCA2 is obtained based on the intake air pressure PM. The second crank rotation angle RCA2 corresponding to the time (concentration change time H) required for the change in the concentration of fuel vapor in the intake passage 14 to become maximal is obtained based on the intake air pressure PM. In this way, the change in the concentration of fuel vapor in the intake passage 14 is determined in correspondence with the crank rotation angle. The fuel injection correction amount is set in accordance with the degree of change in the concentration of fuel vapor (inclination of the curve representing change in the concentration of fuel vapor), which is calculated from the second crank rotation angle RCA2 and the maximum change, so that the degree of the correction is set in accordance with the change in the concentration of fuel vapor in the intake passage 14. This enables proper correction of the fuel injection amount.

When the engine is in a transitional state in which the intake air pressure PM is changing, the amount of fuel vapor flowing into the intake passage 14 constantly changes. In this state, the maximum HC concentration DMAX also constantly changes. Thus, it is difficult to set the degree of correction of the fuel injection amount based on the maximum HC concentration DMAX and the second crank rotation angle RCA2. In this case, the degree of the correction is set as described below.

Figure 6:
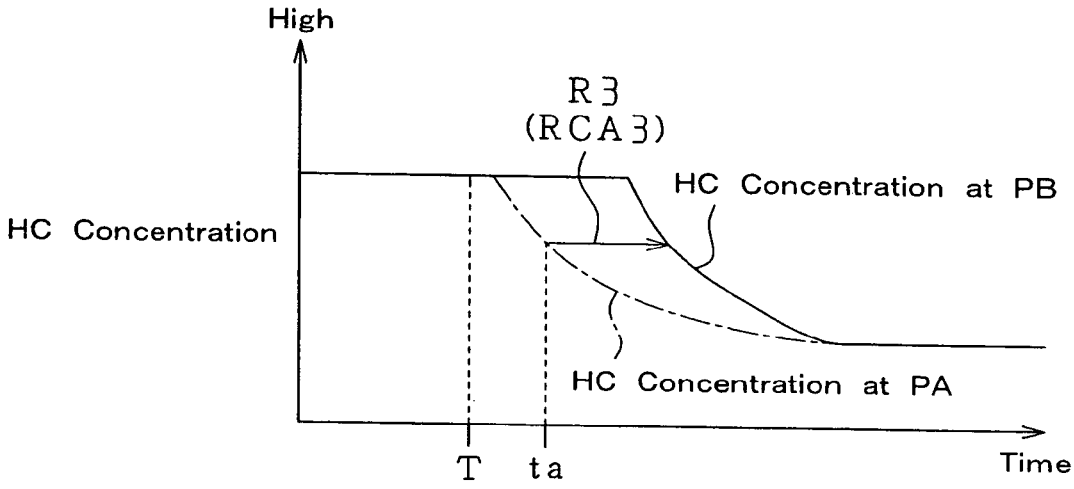
FIG. 6 is a schematic diagram showing changes in the HC concentration near an outlet of a purge passage (position PA) in FIG. 2 and changes in the HC concentration at a position close to a fuel injection valve (position PB) in FIG. 2 when the intake air pressure increases at timing T.
Figure 7:
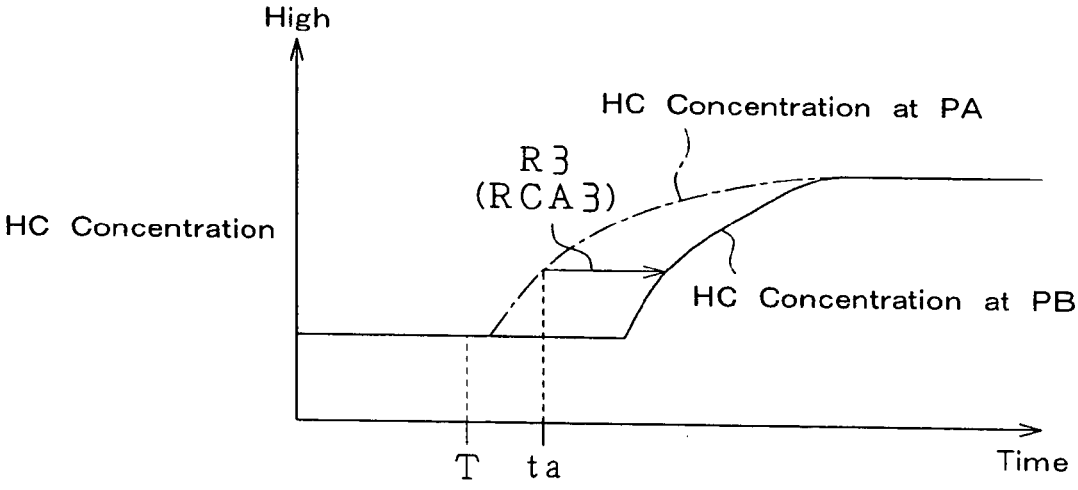
FIG. 7 is a schematic diagram showing changes in the HC concentration at position PA and changes in the HC concentration at position PB when the intake air pressure decreases at timing T.

FIGS. 6 and 7 show changes in the HC concentration at the outlet of the purge passage 33 (position PA) (indicated by broken line) and changes in the HC concentration at the position close to the fuel injection valve 12 (position PB) (indicated by solid line) when the engine is in a transitional state and the intake air pressure PM is changing. FIG. 6 shows the changes in the HC concentration when the intake air pressure PM increases (when the intake air pressure PM approaches the atmospheric pressure, or the negative pressure decreases) at timing T. FIG. 7 shows changes in the HC concentration when the intake air pressure PM decreases (when the intake air pressure PM departs from the atmospheric pressure, or the negative pressure increases) at timing T.

When the intake air pressure PM increases (timing T), the HC concentration at position PA decreases gradually and is ultimately stabilized at a predetermined concentration. The HC concentration at position PA during timing ta is reflected in the HC concentration at position PB after the delay time R3 shown in FIG. 2 elapses.

The change in the HC concentration at the outlet of the purge passage 33 is calculated based on the concentration of fuel vapor (HC concentration) in the purge passage 33, the flow amount of fuel vapor in the purge passage 33, the intake air amount Qa, and the delay time R2 required for the fuel vapor to move from the purge valve 35 to the outlet of the purge passage 33. This calculation yields a value of the HC concentration at the outlet of the purge passage 33 that changes in accordance with the change in the intake air pressure PM. The fuel vapor flow amount decreases as the intake air pressure PM increases, or as the opening degree of the purge valve 35 decreases. Thus, the fuel vapor flow amount is calculated based on the intake air pressure PM or the opening degree of the purge valve 35. For example, the fuel vapor flow amount may be determined with a relational expression, which uses the intake air pressure PM or the opening degree of the purge valve 35 as a variable, or with a map. Further, the delay time R2 is calculated based on the volume of the space in the purge passage 33 between the purge valve 35 and the outlet of the purge passage 33 and the determined fuel vapor flow amount.

The delay time R3 is calculated by subtracting the delay time R2 from the delay time R1 shown in FIG. 2. The delay times R1 and R2 are calculated based on the intake air pressure PM as described above. Thus, the delay time R3 is also calculated with the relational expression using the intake air pressure PM as a variable.

The change in the HC concentration at the outlet of the purge passage 33 is calculated based on the above parameters. A third crank rotation angle RCA3 corresponding to the time required for the fuel vapor to move from the outlet of the purge passage 33 to the position close to the fuel injection valve 12, that is, the delay time R3, is calculated with a relational expression using the intake air pressure PM as a variable. The third crank rotation angle RCA3 is added to the first crank angle CA1, which is the crank angle when the purge valve 35 is operated (opened or closed). This addition yields the third crank angle CA3 corresponding to the time when the fuel vapor from the outlet of the purge passage 33 reaches the position close to the fuel injection valve 12. Even when the engine is in a transitional state when the intake air pressure PM is changing, the timing at which the concentration of fuel vapor at the position close to the fuel injection valve 12 starts changing is properly determined. For fuel injection performed at the third crank angle CA3, the fuel injection correction amount is set in accordance with the change in the concentration of fuel vapor. As a result, the degree of the correction is set in accordance with the change in the concentration of fuel vapor in the intake passage 14. This enables proper correction of the fuel injection amount.

Figure 10:
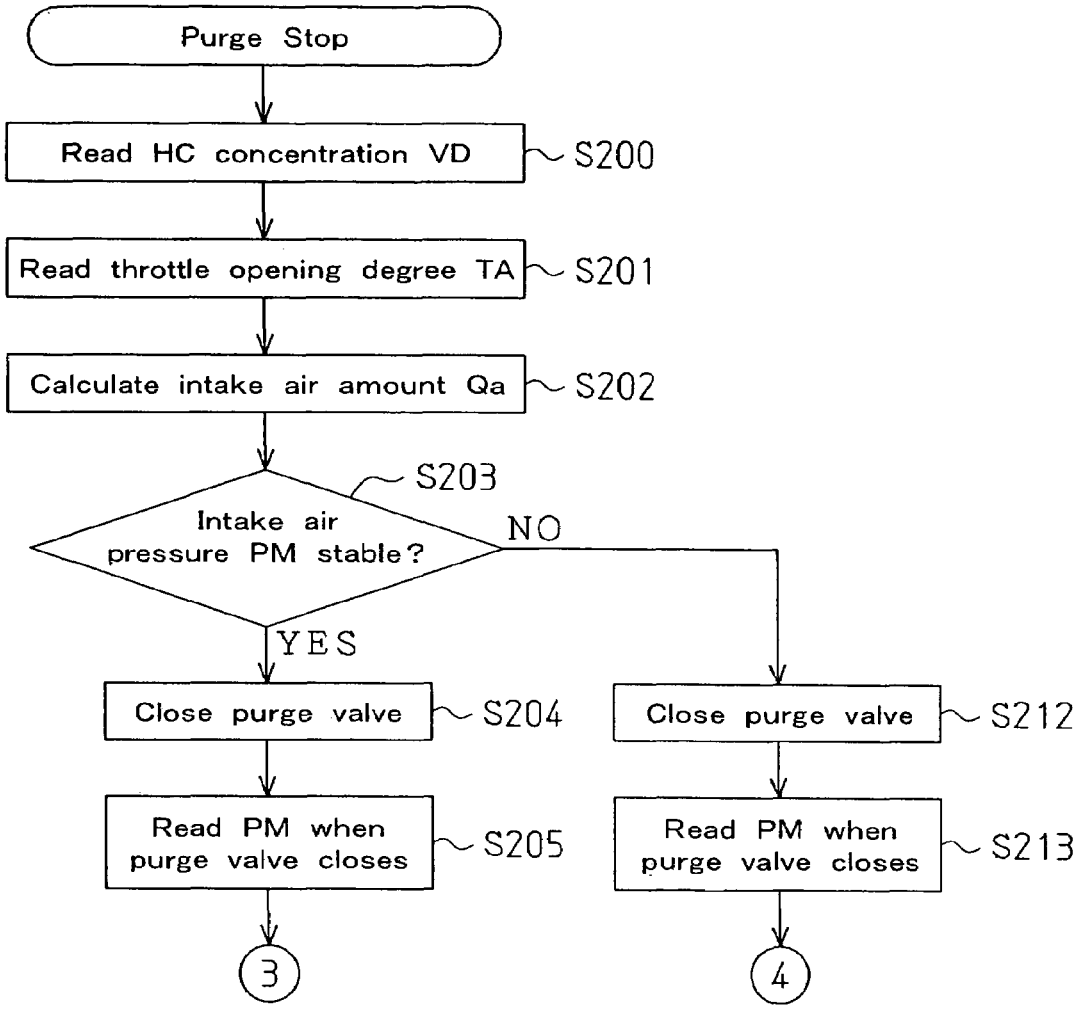
FIG. 10 is a flowchart showing a purge stop control executed when purging is stopped in the preferred embodiment.
Figure 11:
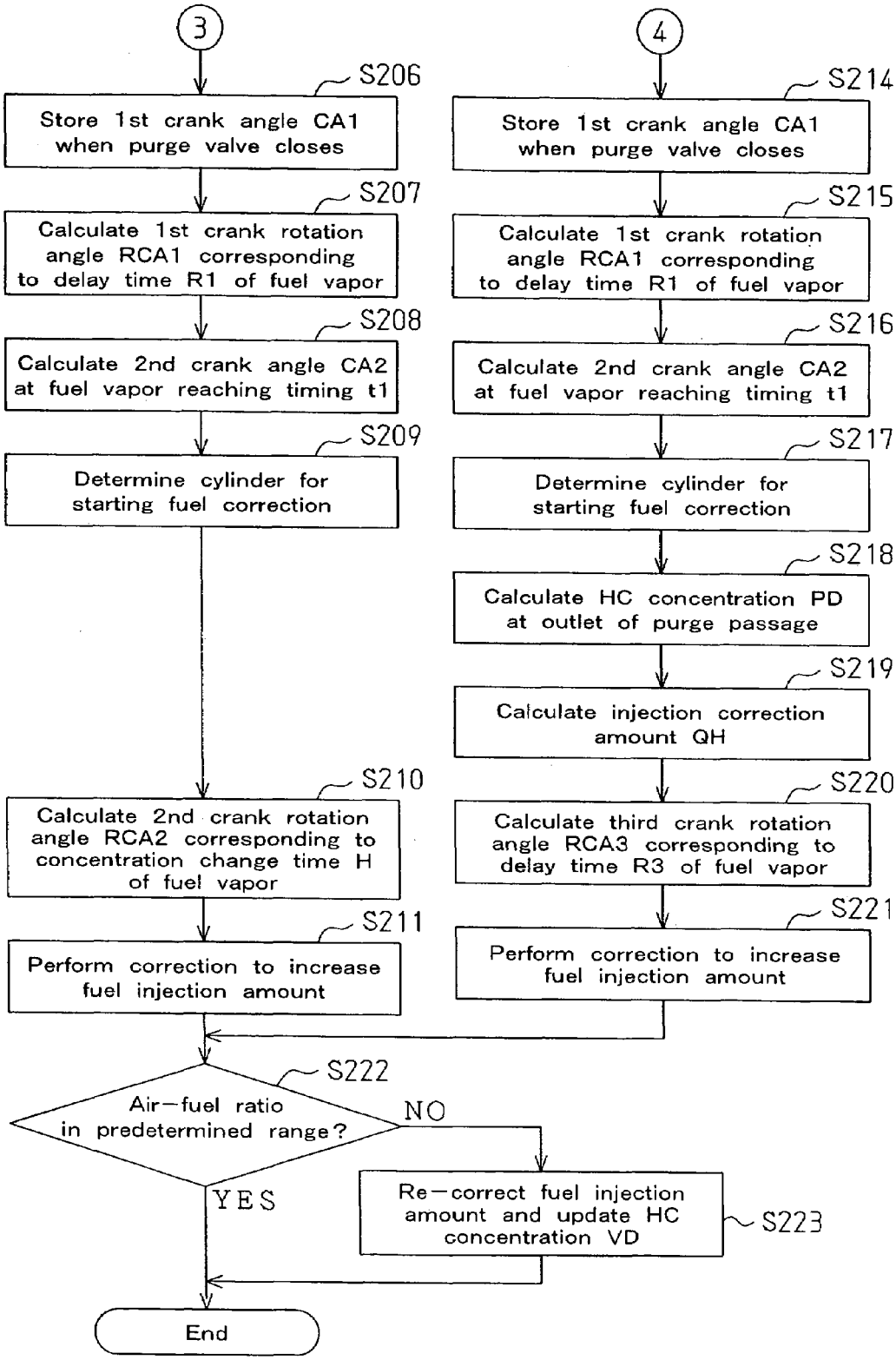
FIG. 11 is a flowchart showing the purge stop control executed when purging is stopped in the preferred embodiment.

Purge control in accordance with the preferred embodiment will now be described with reference to FIGS. 8 to 11. The purge control including the purge start control shown in FIGS. 8 and 9 and the purge stop control shown in FIGS. 10 and 11 is executed by the ECU 40.

The purge start control will first be described. The purge start control is executed when a predetermined purge start condition is satisfied. When the purge start control is started, the ECU 40 first determines whether a purge suspension time PST, which is the time from when the previous purging was stopped to when the present purging is started, is less than a threshold value (reference time) Aref (S100). The threshold value Aref is set at an appropriate value obtained through experiments or the like. The threshold value Aref is set at a value that would cause the HC concentration in the purge passage 33 between the canister 31 and the purge valve 35 to change while purging is being suspended and thus affect the air-fuel ratio if purging is started using the previously calculated HC concentration. In the preferred embodiment, the HC concentration VD immediately before the previous purging is stopped is stored in a memory of the ECU 40. Basically, when the next purging is started, the amount of fuel vapor is calculated based on the HC concentration VD stored in the memory. Thus, when purging is started, the amount of fuel vapor is promptly calculated without requiring the HC concentration DV to be newly detected. This promptly starts correction of the fuel injection amount.

When the purge suspension time PST is greater than or equal to the threshold value Aref (NO in S100), the purge suspension time is relatively long. In this case, the HC concentration VD immediately before the previous purging is stopped and the HC concentration VD when the present purging is started may greatly differ from each other. Thus, the purge valve 35 is open to such a degree that does not adversely affect the air-fuel ratio control (S101). This draws fuel vapor into the intake passage 14. The HC concentration VD is determined based on the change in the air-fuel ratio that occurs when the purge valve 35 opens (S102). The HC concentration VD determined in step S102 is relearned as the HC concentration VD to be used when purging is started. The purge valve 35 is then temporarily closed (S103). Then, step S104 and the subsequent steps are executed. The processing from steps S100 to S103 improves the reliability of the HC concentration VD used when purging is started.

When determined that the purge suspension time PST is less than the threshold value Aref (YES in S100), the present HC concentration VD is read (S104). The HC concentration VD stored immediately before the purging is stopped is read when the determination result in step S100 is affirmative, and the HC concentration VD that is relearned in step S102 is read when the determination result in step S100 is negative.

Next, the present throttle opening degree TA is read (S105). Even if the throttle opening degree TA changes rapidly, there is a delay before the intake air amount changes. Thus, the intake air amount Qa at the timing when the change of the throttle opening degree TA is completed is calculated based on the throttle opening degree TA (S106).

Next, the ECU 40 determines whether or not the present intake air pressure PM is stable (S107). When the present intake air pressure PM is stable (YES in S107), the engine is in the normal state. Thus, step S108 and the subsequent steps are executed.

In step S108, the maximum opening degree VMAX of the purge valve 35 is set (S108). This step is executed for the following reasons. When purging is performed, the amount of fuel vapor drawn into the intake passage 14 is calculated based on the HC concentration VD and the intake air amount Qa. The fuel injection amount is corrected (decreased) in accordance with the calculated amount of fuel vapor. The fuel injection valve 12 has a minimum injection amount. Thus, when the corrected (decreased) fuel injection amount is less than the minimum injection amount of the fuel injection valve 12, the amount of fuel that is actually injected is greater than the corrected fuel injection amount. In this case, the decrease of the fuel injection amount is insufficient. This results in a difference between the fuel injection correction amount and the fuel vapor amount.

Thus, the maximum opening degree VMAX of the purge valve 35 is set to limit the drawn in amount of fuel vapor so that the fuel injection amount corrected in accordance with the fuel vapor amount becomes greater than or equal to the minimum injection amount of the fuel injection valve 12. This enables correction of the fuel injection amount while maintaining the corresponding relationship between the fuel injection correction amount and the fuel vapor amount. Thus, the air-fuel ratio is prevented from being adversely affected by a difference between the fuel injection correction amount and the fuel vapor amount.

Next, the purge valve 35 is opened with an opening degree less than or equal to the set maximum opening degree VMAX, or more preferably with an opening degree close to the maximum opening degree VMAX (S109).

Next, the intake air pressure PM at the timing when the purge valve 35 is open is read (S110). Then, the maximum change of the concentration of fuel vapor in the intake passage 14 at the position close to the fuel injection valve 12, that is, the maximum HC concentration DMAX, is calculated. The maximum HC concentration DMAX is calculated based on the flow amount of fuel vapor in the purge passage 33, the HC concentration VD, and the intake air amount Qa (S111). The flow amount of fuel vapor in the purge passage 33 is determined by the intake air pressure PM and the opening degree of the purge valve 35. The HC concentration VD is the concentration of fuel vapor in the purge passage 33.

Next, the fuel amount corresponding to the calculated maximum HC concentration DMAX is calculated as the injection correction amount QH, by which the fuel injection amount is corrected (S112).

Next, the first crank angle CA1, which is the crank angle when the purge valve 35 opens, is stored in the memory (S113). The first crank rotation angle RCA1 corresponding to the above-described delay time R1 of fuel vapor is calculated based on the intake air pressure PM, which is read in step S110 (S114). The second crank angle CA2, which is the crank angle at timing t1 shown in FIG. 3 when the fuel vapor reaches the position close to the fuel injection valve 12, is calculated (S115). The second crank angle CA2 is a value obtained by adding the first crank rotation angle RCA1 to the first crank angle CA1 as described above.

The first cylinder from which correction of the fuel injection amount is started is determined (S116). The cylinder undergoing the intake stroke when the crankshaft is rotated to the second crank angle CA2 is determined as the first cylinder for starting correction (decrease) of the fuel injection amount.

Next, as the timing when the injection correction amount QH obtained in step S112 is to be reflected in the fuel injection amount, the second crank rotation angle RCA2 corresponding to the concentration change time H described above is calculated based on the intake air pressure PM, which is read in step S110 (S117). The fuel injection amount is corrected (decreased) (S118). In step S118, the fuel injection correction amount is set in accordance with the degree of change in the concentration of fuel vapor, which is determined by the second crank rotation angle RCA2 and the maximum HC concentration DMAX. In other words, the fuel injection correction amount is set in accordance with the inclination of the change in the HC concentration, which increases gradually. The correction is performed using the set correction amount. As a result, the degree of the correction is set in accordance with change in the concentration of fuel vapor in the intake passage 14.

Next, the ECU 40 determines whether the present air-fuel ratio is a value in a predetermined range, which is set in advance, for example, a value in an optimum range for the air-fuel ratio (S131). When the air-fuel ratio is a value in the predetermined range (YES in S131), the purge start control is temporarily terminated.

When the air-fuel ratio is not in the predetermined range (NO in S131), the fuel injection amount is re-corrected based on a feedback signal of the air-fuel ratio. Further, the HC concentration VD is updated based on the re-corrected fuel injection amount (S132). The purge start control is temporarily terminated. Steps S131 and S132 are executed for the reasons described below.

The HC concentration of the fuel vapor drawn into the purge passage 33 from the canister 31 is not fixed but decreases gradually as purging is continuously performed. The HC concentration of fuel vapor is estimated based on the change in the air-fuel ratio that occurs when the purge valve 35 opens. When purging is continuously performed in this case, the actual HC concentration may decrease and become lower than the estimated HC concentration. If this happens, the fuel in the combustion chamber 11 becomes insufficient and causes the air-fuel mixture to become lean. To prevent this, if the air-fuel ratio is excluded from a predetermined range when the fuel injection amount of the fuel injection valve 12 is corrected in accordance with the fuel vapor amount, the fuel injection amount is re-corrected, and the HC concentration VD is updated based on the re-corrected fuel injection amount. In this way, deviation of the air-fuel ratio is corrected by re-correcting the fuel injection amount. The correction amount of the re-correction reflects the difference between the actual HC concentration VD and the estimated HC concentration VD. Thus, the updating of the HC concentration VD based on such a correction amount enables the estimated HC concentration VD to be appropriately corrected.

When the intake air pressure PM is unstable in step S107 (NO in S107), the engine is in a transitional state. In this case, step S119 and the subsequent steps are executed.

In step S119, the ECU 40 determines whether the engine is decelerating (S119). The determination in step S119 is based on various values related with deceleration of the engine, such as values indicating the tendency of changes in the intake air pressure PM and the tendency of changes in the throttle opening degree TA. When the engine is decelerating (YES in S119), the maximum opening degree VMAX of the purge valve 35 is set in the same manner as in step S108 (S120).

When the engine is not decelerating, that is, when the engine is accelerating in step S119 (NO in S119), or when step S120 is completed, the purge valve 35 is opened (S121). When the maximum opening degree VMAX has been set, the purge valve 35 opens at an opening degree that is less than or equal to the maximum opening degree VMAX, or more preferably, at an opening degree close to the maximum opening degree VMAX.

Next, the intake air pressure PM when the purge valve 35 opens is read (S122). The first crank angle CA1, which is the crank angle when the purge valve 35 opens, is stored in the memory (S123). The first crank rotation angle RCA1 corresponding to the delay time R1 of fuel vapor described above is calculated based on the intake air pressure PM, which is read in step S122 (S124). As shown in FIG. 3, the second crank angle CA2, which is the crank angle at timing t1 when the fuel vapor reaches the position close to the fuel injection valve 12 is calculated (S125). The second crank angle CA2 is a value obtained by adding the first crank rotation angle RCA1, which is calculated in step S124, to the first crank angle CA1, which is stored in step S123.

The first cylinder from which correction of the fuel injection amount is started is determined (S126). The cylinder undergoing the intake stroke when the crankshaft is rotated to the second crank angle CA2 is determined as the first cylinder from which correction (decrease) of the fuel injection amount is started.

Next, the HC concentration PD, which is the concentration of fuel vapor at the outlet of the purge passage 33, is calculated (S127). The HC concentration PD at the outlet of the purge passage 33 is calculated based on the HC concentration VD in the purge passage 33, the flow amount of fuel vapor in the purge passage 33, the intake air amount Qa, and the delay time R2 required by the fuel vapor to move from the purge valve 35 to the outlet of the purge passage 33 as described above.

Next, the fuel amount corresponding to the calculated HC concentration PD is calculated as the injection correction amount QH, by which the fuel injection amount is to be corrected (S128).

Next, as the timing when the injection correction amount QH obtained in step S128 is to be reflected in the fuel injection amount, the third crank rotation angle RCA3 corresponding to the above-described delay time R3 of fuel vapor is calculated based on the intake air pressure PM, which is read in step S122 (S129).

The fuel injection amount is corrected (decreased) (S130). In step S130, the third crank rotation angle RCA3 corresponding to the time required by the fuel vapor to move from the outlet of the purge passage 33 to the position close to the fuel injection valve 12, that is, the delay time R3, is added to the first crank angle CA1. The addition yields the third crank angle CA3 corresponding to the timing when the fuel vapor at the outlet of the purge passage 33 reaches the position close to the fuel injection valve 12. For fuel injection performed at the third crank angle CA3, the fuel injection amount that changes in accordance with the engine driving state is decreased by the injection correction amount QH obtained in step S128. This enables the degree of the correction to be set in accordance with a change in the concentration of fuel vapor in the intake passage 14 even when the engine is in a transitional state in which the intake air pressure PM is changing. The intake air pressure PM changes when the engine is in a transitional state. When the intake air pressure PM changes continuously, the fuel injection amount is repetitively corrected by repeating steps S122 and steps S127 to S130.

After step S130 is executed, step S131 and the subsequent steps are executed, and the purge start control is temporarily terminated.

The purge stop control will now be described with reference to FIGS. 10 and 11.

The purge stop control is executed when a predetermined purge stop condition is satisfied. When the purge stop control is started, the present fuel vapor HC concentration VD is read (S200).

Next, the present throttle opening degree TA is read (S201). The intake air amount Qa at the timing when the change of the throttle opening degree TA is completed is calculated based on the throttle opening degree TA in the same manner as in step S106 (S202).

Next, the ECU 40 determines whether the present intake air pressure PM is stable (S203). When the intake air pressure PM is stable (YES in S203), the engine is in the normal state. Thus, the purge valve 35 is closed (S204).

Next, the intake air pressure PM at the timing when the purge valve 35 is closed is read (S205). The first crank angle CA1, which is the crank angle when the purge valve 35 is closed, is stored in the memory (S206). Further, the first crank rotation angle RCA1 corresponding to the above-described delay time R1 of fuel vapor is calculated based on the intake air pressure PM, which is read in step S205 (S207).

As shown in FIG. 3, the second crank angle CA2, which is the crank angle at timing t1 when fuel vapor that has passed through the purge valve 35 immediately before the purge valve 35 is closed reaches the position close to the fuel injection valve 12, is calculated (S208). The second crank angle CA2 is a value obtained by adding the first crank rotation angle RCA1, which is calculated in step S207, to the first crank angle CA1, which is stored in step S206.

The first cylinder from which correction of the fuel injection amount is started is determined (S209). The cylinder undergoing the intake stroke when the crankshaft is rotated to the second crank angle CA2 is determined as the first cylinder from which correction (increase) of the fuel injection amount is started.

Next, as the time the fuel injection amount corrected (decreased) by the fuel amount corresponding to the maximum HC concentration DMAX, or the injection correction amount QH, is increased to the fuel injection amount before correction through purging is calculated, the second crank rotation angle RCA2 corresponding to the concentration change time H described above is calculated based on the intake air pressure PM, which is read in step S205 (S210). The fuel injection amount is corrected (increased) (S211). In step S210, the fuel injection correction amount is set in accordance with the change degree of the concentration of fuel vapor, which is determined by the second crank rotation angle RCA2 and the maximum HC concentration DMAX. In other words, the fuel injection correction amount is set in accordance with the inclination of the change in the HC concentration, which decreases gradually. The correction is performed using the set correction amount. In this way, the fuel injection amount is corrected in accordance with the change in the concentration of fuel vapor in the intake passage 14.

Next, the ECU 40 determines whether the present air-fuel ratio is a value in a predetermined range, which is set in advance, for example, a value in an optimum range for the air-fuel ratio (S222). When the air-fuel ratio is a value in the predetermined range (YES in S222), the purge stop control is temporarily terminated.

When the air-fuel ratio is included in the predetermined range (NO in S222), the fuel injection amount is re-corrected based on a feedback signal of the air-fuel ratio. Further, the HC concentration VD is updated based on the re-corrected fuel injection amount (S223). The purge stop control is temporarily terminated. Steps S222 and S223 are executed for the same reasons as the reasons for executing steps S131 and S132.

When the intake air pressure PM is unstable in step S203 (NO in S203), the engine is in a transitional state. Thus, the purge valve 35 is closed (S212).

Next, the intake air pressure PM when the purge valve 35 is closed is read (S213). The first crank angle CA1, which is the crank angle when the purge valve 35 is closed, is stored in the memory (S214). The first crank rotation angle RCA1 corresponding to the delay time R1 of fuel vapor described above is calculated based on the intake air pressure PM, which is read in step S213 (S215).

As shown in FIG. 3, the second crank angle CA2, which is the crank angle at timing t1 when the fuel vapor that has passed through the purge valve 35 immediately before the purge valve 35 closes reaches the position close to the fuel injection valve 12, is calculated (S216). The second crank angle CA2 is a value obtained by adding the first crank rotation angle RCA1, which is calculated in step S215, to the first crank angle CA1, which is stored in step S214.

The first cylinder from which correction of the fuel injection amount is started is determined (S217). The cylinder undergoing the intake stroke when the crankshaft is rotated to the second crank angle CA2 is determined as the first cylinder from which correction (increase) of the fuel injection amount is started.

Next, the HC concentration PD, which is the concentration of fuel vapor at the outlet of the purge passage 33, is calculated (S218). The HC concentration PD at the outlet of the purge passage 33 is calculated based on the HC concentration VD in the purge passage 33, the flow amount of fuel vapor in the purge passage 33, the intake air amount Qa, and the delay time R2 required by the fuel vapor to move from the purge valve 35 to the outlet of the purge passage 33 as described above.

Next, the fuel amount corresponding to the calculated HC concentration PD is calculated as the injection correction amount QH, by which the fuel injection amount is to be corrected (S219).

Next, as the timing when the injection correction amount QH obtained in step S219 is to be reflected in the fuel injection amount, the third crank rotation angle RCA3 corresponding to the above-described delay time R3 of fuel vapor is calculated. The third crank rotation angle RCA3 is calculated based on the intake air pressure PM, which is read in step S213 (S220).

The fuel injection amount is corrected (increased) (S221). In step S221, the same processing as the processing in step S130 is executed. More specifically, the third crank rotation angle RCA3 corresponding to the time required by the fuel vapor to move from the outlet of the purge passage 33 to the position close to the fuel injection valve 12, that is, the delay time R3, is added to the first crank angle CA1. The addition yields the third crank angle CA3 corresponding to when the fuel vapor at the outlet of the purge passage 33 reaches the position close to the fuel injection valve 12. For fuel injection performed at the third crank angle CA3, the fuel injection amount that changes in accordance with the engine driving state is decreased by the injection correction amount QH obtained in step S219. The injection correction amount QH decreases gradually as time elapses. Thus, in step S221, the fuel injection amount of the fuel injection valve 12 is substantially corrected (increased) as time elapses.

Thus, the degree of the correction is set in accordance with the change in the concentration of fuel vapor in the intake passage 14 even when the engine is in a transitional state in which the intake air pressure PM changes. The intake air pressure PM changes while the engine is in a transitional state. When the intake air pressure PM changes continuously, the fuel injection amount is repetitively corrected by repeating steps S213 and steps S218 to S221.

After step S221 is executed, step S222 and the subsequent steps are executed, and the purge stop control is temporarily terminated.

In the preferred embodiment, the timing when the fuel injection amount is corrected (increased or decreased) is determined in correspondence with the crank angle and the crank rotation angle. Further, change in the concentration of fuel vapor is detected in correspondence with the crank rotation angle. This facilitates application of the above correction to fuel injection control executed by referring to the crank angle.

The preferred embodiment has the advantages described below.

(1) The crank angle when the purge valve 35 opens is stored as the first crank angle. The crank rotation angle in which the crankshaft is rotated during the delay time R1, which is the time required for fuel vapor to move from the purge valve 35 to the position close to the fuel injection valve 12, is calculated as the first crank rotation angle RCA1. The first crank rotation angle RCA1 is calculated based on the intake air pressure PM. The second crank angle CA2 is then calculated by adding the first crank rotation angle RCA1 to the first crank angle CA1. Correction (decrease) of the fuel injection amount is started from the cylinder that is undergoing the intake stroke when the crankshaft is rotated to the second crank angle CA2. Thus, for correction (decrease) of the fuel injection amount performed when purging is started, the timing when the concentration of fuel vapor at the position close to the fuel injection valve 12 starts changing is optimally detected. This enables optimal fuel injection correction in accordance with changes in the concentration of fuel vapor. As a result, the correction accuracy of the fuel injection amount is prevented from being lowered by the difference between the purged amount of fuel vapor and the fuel injection correction amount. This enables a larger amount of fuel vapor to be purged.

(2) The crank angle when the purge valve 35 is closed is stored as the first crank angle. The crank rotation angle in which the crankshaft is rotated during the delay time R1, which is the time required by fuel vapor to move from the purge valve 35 to the position close to the fuel injection valve 12, is calculated as the first crank rotation angle RCA1. The first crank rotation angle RCA1 is calculated based on the intake air pressure PM. The second crank angle CA2 is then calculated by adding the first crank rotation angle RCA1 to the first crank angle CA1. Correction (increase) of the fuel injection amount is started from the cylinder undergoing the intake stroke when the crankshaft is rotated to the second crank angle CA2. Thus, for correction (increase) of the fuel injection amount performed when purging is stopped, the timing when the concentration of fuel vapor at the position close to the fuel injection valve 12 starts changing is detected in a preferable manner. This enables fuel injection correction to be in accordance with the concentration of fuel vapor. As a result, the correction accuracy of the fuel injection amount is prevented from being lowered by a difference between the purged amount of fuel vapor and the fuel injection correction amount. This enables a larger amount of fuel vapor to be purged.

(3) If the engine is being driven when the intake air pressure PM in the intake passage 14 is stable (normal state), the maximum HC concentration DMAX, which is the maximum change in the concentration of fuel vapor in the intake passage 14, is calculated. Further, the crank rotation angle corresponding to the time required for the concentration of fuel vapor in the intake passage 14 to reach the maximum HC concentration DMAX is calculated as the second crank rotation angle RCA2. The second crank rotation angle RCA2 is calculated based on the intake air pressure PM when the purge valve 35 opens. The fuel injection correction amount is set in accordance with the change degree of the concentration of fuel vapor, which is determined by the second crank rotation angle RCA2 and the maximum HC concentration DMAX. Thus, when the engine is in the normal state, the degree of the correction is set to respond to the change in the concentration of fuel vapor in the intake passage 14.

The maximum HC concentration DMAX changes in accordance with the change in the intake air pressure PM in the intake passage 14. In the preferred embodiment, the maximum HC concentration DMAX is calculated when the engine is in the normal state. Thus, the maximum HC concentration DMAX is calculated as a stable value.

(4) When the engine is in a transitional state and the intake air pressure PM in the intake passage 14 is changing, a change in the concentration of fuel vapor at the outlet of the purge passage 33 is calculated, and the crank rotation angle corresponding to the time required by the calculated change in the concentration of fuel vapor at the outlet of the purge passage 33 to be reflected in the intake air at the position close to the fuel injection valve 12 is calculated as the third crank rotation angle RCA3. The third crank rotation angle RCA3 is calculated based on the intake air pressure PM. The third crank angle CA3 is then calculated by adding the third crank rotation angle RCA3 to the first crank angle CA1. For fuel injection performed at the third crank angle CA3, the fuel injection correction amount is set in accordance with the change in the concentration of fuel vapor. Thus, when the engine is in a transitional state and the intake air pressure PM in the intake passage 14 is changing, the degree of the correction is set to respond to the change in the concentration of fuel vapor in the intake passage 14. This enables appropriate correction of the fuel injection amount.

(5) When the purge valve 35 is open, the introduction amount of fuel vapor is limited so that the fuel injection amount corrected in accordance with the fuel vapor amount becomes greater than or equal to the minimum injection amount of the fuel injection valve 12. More specifically, the maximum opening degree VMAX of the purge valve 35 is set. This enables fuel injection correction to be performed while maintaining the corresponding relationship between the fuel injection correction amount and the fuel vapor amount. The air-fuel ratio is prevented from being lowered by the difference between the fuel injection correction amount and the fuel vapor amount.

(6) The HC concentration VD immediately before purging is stopped is stored. The stored HC concentration VD is used to calculate the fuel vapor amount when next purging is performed. Thus, when purging is started, the amount of fuel vapor is promptly calculated without requiring the concentration of fuel vapor to be newly detected. This enables correction of the fuel injection amount to be started promptly.

(7) When purging is suspended for a relatively long time, the concentration of fuel vapor immediately before purging is stopped and the concentration of fuel vapor when purging is started may greatly differ from each other. In the preferred embodiment, the concentration of fuel vapor is updated when the purge suspension time PST is greater than the threshold value Aref. This improves the reliability of the concentration of fuel vapor when purging is started.

(8) If the air-fuel ratio is excluded from the predetermined range when the fuel injection amount of the fuel injection valve 12 is corrected in accordance with the fuel vapor amount, the fuel injection amount is re-corrected and the HC concentration VD is updated based on the re-corrected fuel injection amount. In the preferred embodiment, the HC concentration VD is estimated based on the air-fuel ratio when the purge valve 35 opens. Deviation of the air-fuel ratio is corrected by re-correcting the fuel injection amount. The HC concentration VD is updated based on the re-corrected fuel injection amount. This enables the estimated HC concentration VD to be corrected in an appropriate manner.

It should be apparent to those skilled in the art that the present invention may be embodied in many other specific forms without departing from the spirit or scope of the invention. Particularly, it should be understood that the present invention may be embodied in the following forms.

Figure 8:
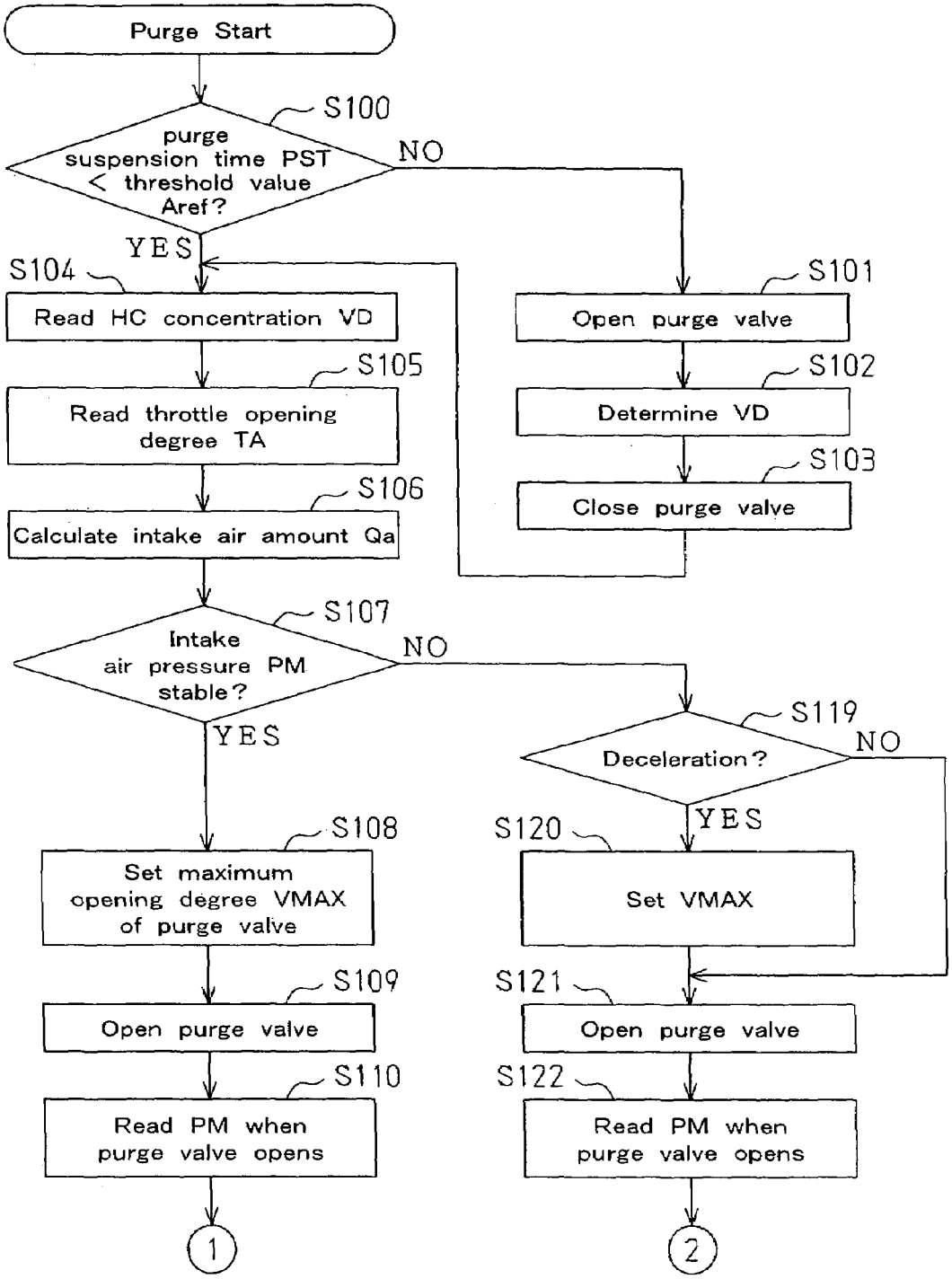
FIG. 8 is a flowchart showing a purge start control executed when purging is started in the preferred embodiment.
Figure 9:
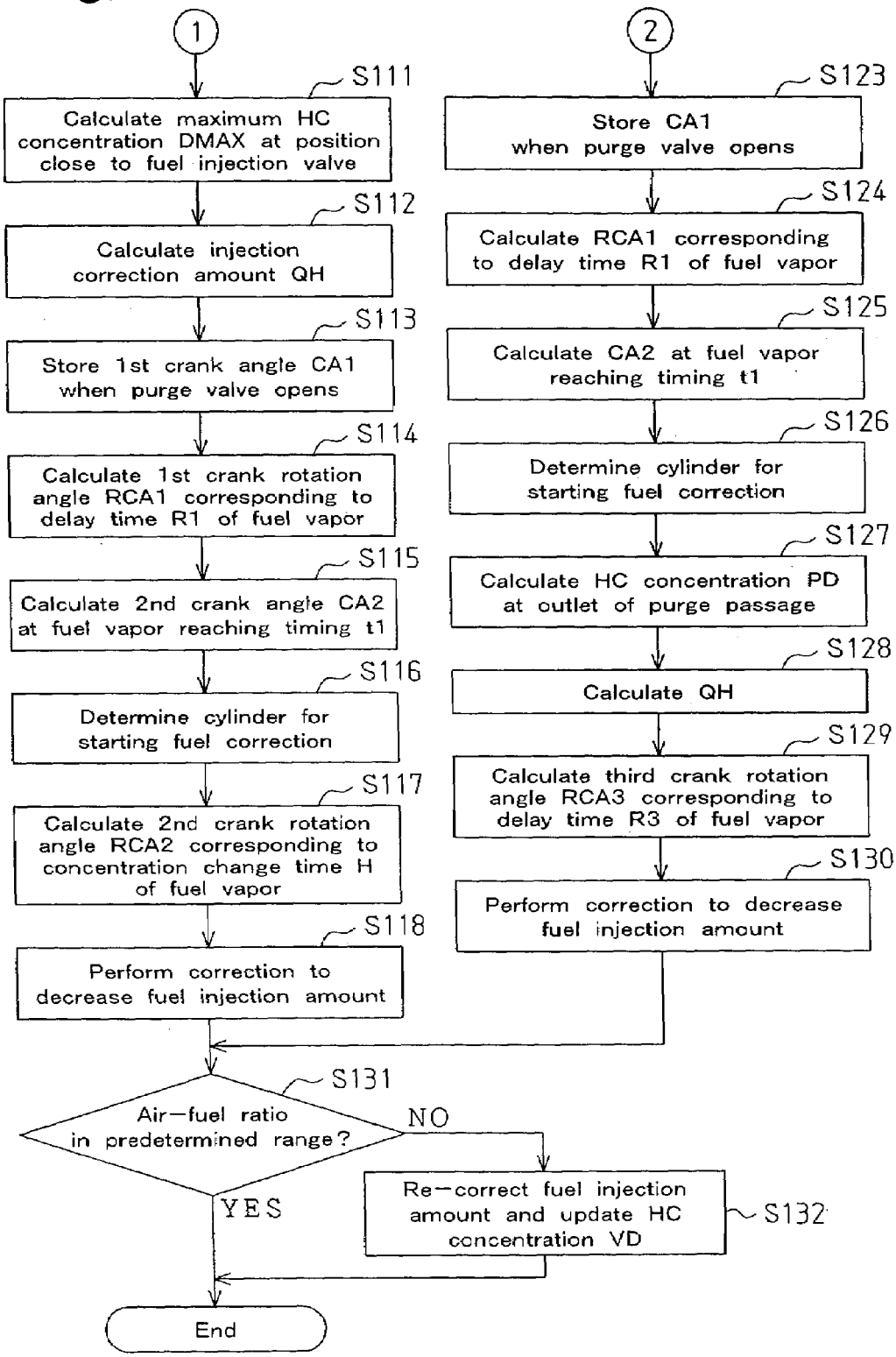
FIG. 9 is a flowchart showing the purge start control executed when purging is started in the preferred embodiment.

In the preferred embodiment, the processing for the purge start control shown in FIGS. 8 and 9 may solely be executed. In this case, all of the advantages described above except for advantage (2) are obtained. Alternatively, the processing for the purge strop control shown in FIGS. 10 and 11 may solely be executed. In this case, all of the advantages described above except for advantage (1) are obtained.

The timing for starting correction that increases or decreases the fuel injection amount may solely be determined. In this case, advantage (1) or advantage (2) is obtained.

In the preferred embodiment, the maximum opening degree VMAX of the purge valve 35 is set to limit the introduction amount of fuel vapor so that the corrected fuel injection amount becomes greater than or equal to the minimum injection amount of the fuel injection valve 12. Alternatively, the maximum opening degree VMAX of the purge valve 35 may be set to limit the introduction amount of fuel vapor so that the ratio of the fuel injection amount before correction relative to after correction is equal to a predetermined value.

The amount of drawn in fuel vapor is also limited in this case. Thus, fuel injection correction is performed while maintaining the correspondence relationship between the fuel injection correction amount and the fuel vapor amount. The air-fuel ratio is prevented from being lowered by a difference between the fuel injection correction amount and the fuel vapor amount.

The processing for setting the maximum opening degree VMAX may be eliminated. In this case, the advantages described above except for advantage (5) are obtained.

The HC concentration VD immediately before purging is stopped does not have to be stored. In this case, a processing for estimating the HC concentration VD is always executed before purging is started. In this case, the advantages described above except for advantage (6) are obtained.

The comparison between the purge suspension time PST and the threshold value Aref (S100) may be eliminated. In this case, the advantages described above except for advantage (7) are obtained.

When the air-fuel ratio is excluded from the predetermined range after the fuel injection amount of the fuel injection valve 12 is corrected in accordance with the fuel vapor amount, the fuel injection amount is re-corrected, and the HC concentration VD is updated based on the re-corrected fuel injection amount. However, this processing may be eliminated. In this case, the advantages described above except for advantage (8) are obtained.

The HC concentration VD may be directly detected by a sensor arranged in the purge passage 33. In this case, the HC concentration VD is constantly updated. In this case, steps S100 to S103 and the processing for storing the HC concentration VD immediately before purging is stopped are eliminated.

In the preferred embodiment, the first crank rotation angle RCA1 and the second crank rotation angle RCA2 are determined using a relational expression. However, the first crank rotation angle RCA1 and the second crank rotation angle RCA2 may be stored in the memory of the ECU 40 in correspondence with the intake air pressure.

The HC concentration VD may be estimated using a method differing from the method described above.

The controller for the internal combustion engine according to the preferred embodiment and its modifications is applicable not only to a gasoline engine having ignition plugs but also to a diesel engine.

The present examples and embodiments are to be considered as illustrative and not restrictive, and the invention is not to be limited to the details given herein, but may be modified within the scope and equivalence of the appended claims.

What is claimed is:

1. A controller for an internal combustion engine connected to a fuel tank, the engine including a crankshaft, at least one cylinder, at least one fuel injection valve associated with the at least one cylinder, and a fuel vapor processing mechanism, the fuel vapor processing mechanism including:

a canister for collecting fuel vapor generated in the fuel tank;

a purge passage, connecting the canister and an intake passage of the internal combustion engine, for purging fuel vapor desorbed from the canister into the intake passage; and a purge valve, arranged in the purge passage, for adjusting fuel vapor amount in the purge passage;

the controller comprising:

a memory for storing a first crank angle, which is an angle of the crankshaft at the timing of opening of the purge valve; and a processor for determining a first crank rotation angle by which the crankshaft is rotated during a delay time required for the fuel vapor to move from the purge valve to a position closer to the fuel injection valve, based on intake air pressure in the intake passage, and for adding the first crank rotation angle to the first crank angle to determine a second crank angle, wherein the controller determines the amount of fuel vapor drawn into the intake passage based on concentration of the fuel vapor that is purged into the purge passage and corrects a fuel injection amount for the at least one fuel injection valve in accordance with the determined amount of fuel vapor, wherein the controller starts decreasing the fuel injection amount from the cylinder that is undergoing an intake stroke when the crankshaft is rotated to the second crank angle.

2. The controller according to claim 1, wherein:

when the purge valve opens, the controller determines a correction amount in accordance with the determined amount of fuel vapor, and determines the cylinder that is undergoing the intake stroke when the crankshaft is rotated to the second crank angle; and when the crankshaft is rotated to the second crank angle, the controller controls the fuel injection valve associated with the determined cylinder to start injecting an amount of fuel decreased by the correction amount.

3. The controller according to claim 1, wherein when the purge valve opens, the controller limits the amount of fuel vapor drawn into the intake passage so that the corrected fuel injection amount becomes greater than or equal to a minimum injection amount of the at least one fuel injection valve.

4. The controller according to claim 3, wherein the controller limits a maximum opening degree of the purge valve to limit the amount of fuel vapor drawn into the intake passage.

5. The controller according to claim 1, wherein when the purge valve opens, the controller limits the amount of fuel vapor drawn into the intake passage so that a ratio between the fuel injection amount before correction and the fuel injection amount after correction becomes equal to a predetermined value.

6. The controller according to claim 1, wherein when the intake air pressure in the intake passage is stable, the processor:

determines a maximum change in concentration of the fuel vapor in the intake passage based on the concentration of the fuel vapor in the purge passage, the amount of fuel vapor flowing in the purge passage, and engine intake air amount;

determines a second crank rotation angle by which the crankshaft is rotated during time required for the concentration of fuel vapor in the intake passage to reach the maximum change, based on the intake air pressure when the purge valve opens; and sets a correction amount for the fuel injection amount in accordance with a concentration change degree that is determined by the second crank rotation angle and the maximum change.

7. The controller according to claim 1, wherein the purge passage has an outlet connected to the intake passage, and the processor:

determines a change in the concentration of the fuel vapor at the outlet of the purge passage when the engine is in a transitional state in which the intake air pressure in the intake passage is changing based on the concentration of the fuel vapor in the purge passage, the amount of fuel vapor flowing in the purge passage, an intake air amount of the engine, and a delay time required for the fuel vapor that has passed through the purge valve to reach the outlet of the purge passage;

determines a third crank rotation angle by which the crankshaft is rotated during time required for the determined change in the concentration of fuel vapor at the outlet of the purge passage to be reflected to change in concentration of intake air at the position closer to the fuel injection valve, based on the intake air pressure;

determines a third crank angle by adding the third crank rotation angle to the first crank angle; and sets, for fuel injection performed when the crankshaft is rotated to the third crank angle, a correction amount for the fuel injection amount in accordance with the change in the concentration of fuel vapor.

8. The controller according to claim 1, wherein the memory stores concentration of the fuel vapor immediately before purging is stopped, and the processor determines the amount of fuel vapor drawn into the intake passage when purging is performed next based on the concentration stored in the memory.

9. The controller according to claim 8, wherein the processor updates the fuel vapor concentration stored in the memory when time during which purging is suspended is greater than a reference time.

10. The controller according to claim 1, further comprising:

a concentration sensor, arranged in the purge passage, for detecting concentration of the fuel vapor in the purge passage.

11. The controller according to claim 1, wherein the processor detects change in air-fuel ratio that occurs when the purge valve opens and estimates the concentration of the fuel vapor from the detected change in the air-fuel ratio.

12. The controller according to claim 11, wherein if the air-fuel ratio is excluded from a predetermined range when the fuel injection valve injects the corrected amount of fuel, the processor re-corrects the fuel injection amount and updates the concentration of fuel vapor in the purge passage based on the re-corrected fuel injection amount.

13. A controller for an internal combustion engine connected to a fuel tank, the engine including a crankshaft, at least one cylinder, at least one fuel injection valve associated with the at least one cylinder, and a fuel vapor processing mechanism, the fuel vapor processing mechanism including:

a canister for collecting fuel vapor generated in the fuel tank;

a purge passage, connecting the canister and an intake passage of the internal combustion engine, for purging fuel vapor desorbed from the canister into the intake passage; and a purge valve, arranged in the purge passage, for adjusting fuel vapor amount in the purge passage;

the controller comprising:

a memory for storing a first crank angle, which is an angle of the crankshaft at the timing of closing of the purge valve, wherein the controller determines fuel vapor amount drawn into the intake passage based on concentration of the fuel vapor that is purged into the purge passage, and the controller corrects a fuel injection amount of the at least one fuel injection valve in accordance with the determined amount of fuel vapor; and a processor for determining a first crank rotation angle, by which the crankshaft is rotated during a delay time required for the fuel vapor to move from the purge valve to a position close to the fuel injection valve, based on intake air pressure in the intake passage, and for adding the first crank rotation angle to the first crank angle to determine a second crank angle, wherein the controller starts increasing the fuel injection amount from the cylinder that is undergoing an intake stroke when the crankshaft is rotated to the second crank angle.

14. The controller according to claim 13, wherein:

when the purge valve closes, the processor determines a correction amount that is in accordance with the determined amount of fuel vapor, and determines the cylinder that is undergoing the intake stroke when the crankshaft is rotated to the second crank angle; and when the crankshaft is rotated to the second crank angle, the controller controls the fuel injection valve associated with the determined cylinder to start injecting an amount of fuel increased by the correction amount.

15. The controller according to claim 13, wherein when the intake air pressure in the intake passage is stable, the processor:

determines a maximum change in concentration of the fuel vapor in the intake passage based on the concentration of the fuel vapor in the purge passage, the amount of fuel vapor flowing in the purge passage, and engine intake air amount;

determines a second crank rotation angle, by which the crankshaft is rotated during time required for the concentration of fuel vapor in the intake passage to reach the maximum change, based on the intake air pressure at the time of closing of the purge valve; and sets a correction amount for the fuel injection amount in accordance with a concentration change degree that is determined by the second crank rotation angle and the maximum change.

16. The controller according to claim 13, wherein the purge passage has an outlet connected to the intake passage, and the processor:

determines a change in the concentration of the fuel vapor at the outlet of the purge passage when the engine is in a transitional state in which the intake air pressure in the intake passage is changing based on the concentration of the fuel vapor in the purge passage, the amount of fuel vapor flowing in the purge passage, engine intake air amount, and a delay time required for the fuel vapor that has passed through the purge valve to reach the outlet of the purge passage;

determines a third crank rotation angle, by which the crankshaft is rotated during time required for the determined change in the concentration of fuel vapor at the outlet of the purge passage to be reflected to change in concentration of intake air at the position close to the fuel injection valve, based on the intake air pressure;

determines a third crank angle by adding the third crank rotation angle to the first crank angle; and sets, for fuel injection performed when the crankshaft is rotated to the third crank angle, a correction amount of the fuel injection amount in accordance with the change in the concentration of fuel vapor.

17. The controller according to claim 13, wherein the memory stores concentration of the fuel vapor immediately before purging is stopped, and the processor determines the amount of fuel vapor drawn into the intake passage when purging is performed next based on the concentration stored in the memory.

18. The controller according to claim 17, wherein the processor updates the fuel vapor concentration stored in the memory when time during which purging is suspended is greater than a reference time.

19. The controller according to claim 13, further comprising:

a concentration sensor, arranged in the purge passage, for detecting concentration of the fuel vapor in the purge passage.

20. The controller according to claim 13, wherein the processor detects change in air-fuel ratio that occurs when the purge valve opens and estimates the concentration of the fuel vapor from the detected change in the air-fuel ratio.

21. The controller according to claim 20, wherein if the air-fuel ratio is excluded from a predetermined range when the fuel injection valve injects the corrected amount of fuel, the processor re-corrects the fuel injection amount and updates the concentration of fuel vapor in the purge passage based on the re-corrected fuel injection amount.

* * * * *